US006038410A

United States Patent [19]

Iriyama

[11] Patent Number: 6,038,410

[45] Date of Patent: Mar. 14, 2000

[54] DUPLEX IMAGE-FORMING APPARATUS

[75] Inventor: Norio Iriyama, Hachioji, Japan

[73] Assignee: Konica Corporation, Japan

[21] Appl. No.: 09/175,280

[22] Filed: Oct. 20, 1998

[30] Foreign Application Priority Data

Oct. 22, 1997 [JP] Japan ..... 9-289808

[51] Int. Cl.[7] ..... G03G 15/043

[52] U.S. Cl. ..... 399/51; 399/66; 399/301; 399/309; 399/388; 399/394

[58] Field of Search ..... 399/51.66, 301, 399/302, 308, 309, 394, 401, 388, 396; 347/234, 235, 248, 250; 226/45

[56] References Cited

U.S. PATENT DOCUMENTS

| | | | |
|---|---|---|---|
| 5,023,668 | 6/1991 | Kluy et al. | 399/308 |
| 5,761,573 | 6/1998 | Haneda et al. | 399/66 |
| 5,790,930 | 8/1998 | Fuchiwaki et al. | 399/302 |
| 5,930,572 | 7/1999 | Haneda et al. | 399/309 |
| 5,930,577 | 7/1999 | Forsthoefel et al. | 399/401 |
| 5,970,295 | 10/1999 | Samizo et al. | 399/309 |

*Primary Examiner*—William Royer
*Assistant Examiner*—William A. Noë
*Attorney, Agent, or Firm*—Jordan B. Bierman; Bierman, Muserlian and Lucas

[57] ABSTRACT

There is described an image forming apparatus to form an image on a transfer sheet, in which an image bearing member, image exposing unit for forming a latent image, developing unit for developing the latent image, an intermediate image bearing member for bearing a toner image on its surface, first transfer member for transferring the toner image from the image bearing member to the intermediate image bearing member or the first side of the transfer sheet, second transfer member for transferring said toner image from the intermediate image bearing member to the second side of the transfer sheet, fixing unit for fixing the toner images on the both sides of the transfer sheet, detector for detecting a reference position on the intermediate image bearing member, and controller for controlling timing to start forming the latent image and/or timing to feed the transfer sheet to the first transfer member on the basis of the detection of the reference position on the intermediate image bearing member, are. included.

4 Claims, 8 Drawing Sheets

FIG. 3 ( a )
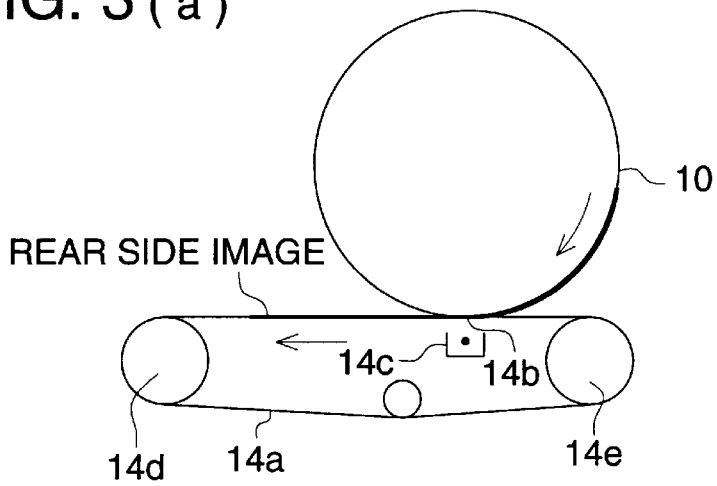
FIG. 3 ( b )
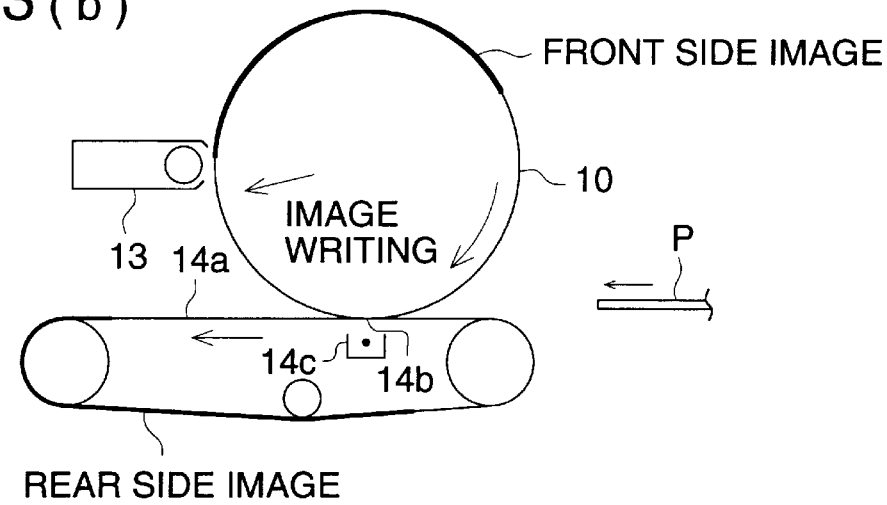
FIG. 3 ( c )
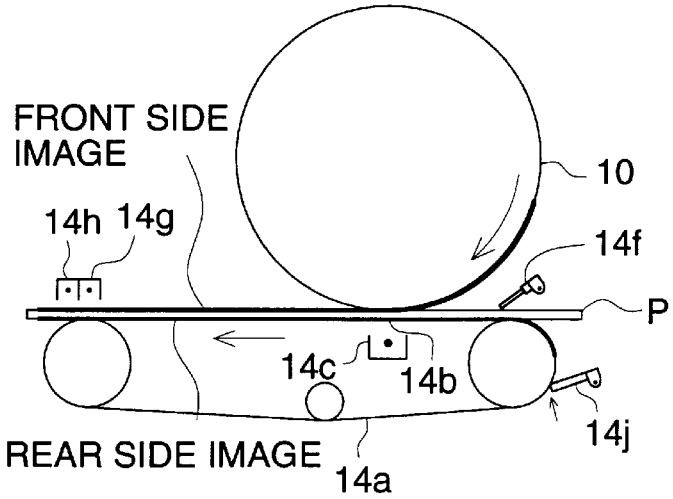

FIG. 5 ( a )
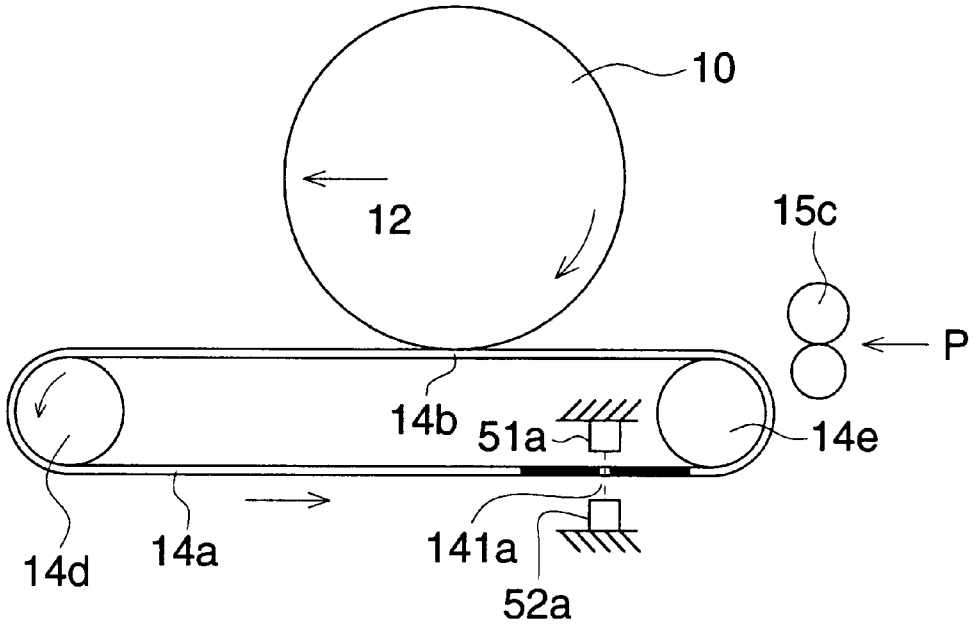
FIG. 5 ( b )
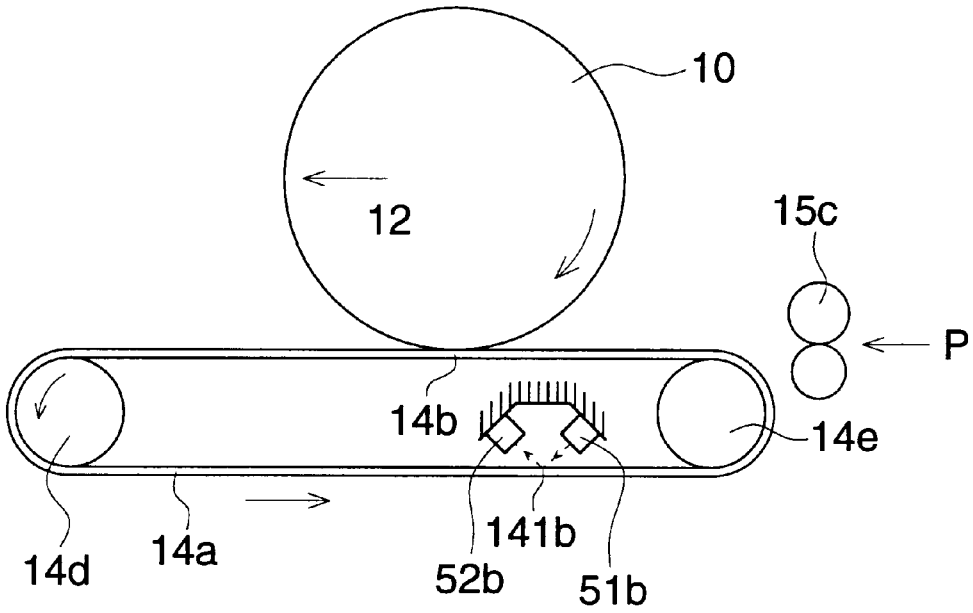

DUPLEX IMAGE-FORMING APPARATUS

BACKGROUND OF THE INVENTION

This invention relates to an image forming apparatus which forms images by an electrophotographic method, and in particular, to an image forming apparatus which forms double-sided copies (hereinafter referred to as a duplex image forming for simplicity's sake) by forming toner images on both sides of a transfer material and fixing them together at time.

Duplex copying, wherein toner images are formed on both sides of the transfer material, has been known in the prior art. In such methods, the image for one side is transferred onto the transfer material and fixed; thereafter, the transfer material is reversed by manipulation within the machine and the second image is transferred onto the second side and is thereafter fixed.

In this type of duplex copying apparatus, as mentioned above, the transport of the transfer material is carried out in such a manner as to feed it to the reverse paper feeding device for duplex and to make it go through the fixing apparatus twice; hence, a long processing time for copying is required due to the long transport path of the transfer material, and further, it decreases the reliability of transfer material transport and causes a paper jam to occur frequently that the transfer paper, which is made curled due to having once passed through the fixing apparatus, is again transported.

On the other hand, the applicant has been studying a method of duplex image forming wherein a toner image formed on an image bearing member (a first image bearing means) is temporarily transferred onto an intermediate transfer member (a second image bearing means). Then, the front toner image is formed on the image bearing member and the transfer material is introduced between the image bearing member and the intermediate transfer member. With proper timing, the reverse toner image is transferred from the intermediate transfer member to the reverse side of the transfer material and the front toner image is transferred directly from the image bearing member to the front side of the transfer material. These transfers are carried out simultaneously.

Such a method of duplex image forming as mentioned above, can solve the above-described problem but has had a problem too. In the duplex image forming apparatus employing such a method, there is provided a stored program for image forming compiled in advance, and at the time of duplex image forming, the following are controlled in accordance with the stored program: the timing of driving for rotation of the image bearing member and the intermediate transfer member, the timing of image writing by charging and image exposure, and the timing of the feeding of the transfer material to the transfer area, and a front side image and a rear side image are formed on the both sides of a transfer member; heretofore, studies have been carried out on the above-mentioned method.

However, because an image bearing belt, which will be explained later, is used for the intermediate transfer member, it is difficult to prevent a speed fluctuation due to the elongation (the variation of the peripheral length) of the intermediate transfer member in use, the slippage between the driving roller and the intermediate transfer member, the load variation to the drive motor for driving the intermediate transfer member, etc. Because of the foregoing fluctuations, it has been found that copies are made wherein the leading edge of the front toner image and/or the leading edge of the rear toner image do not coincide with the leading edge of the transfer material.

SUMMARY OF THE INVENTION

It is an object of this invention to solve the above-mentioned problem and to provide an image forming apparatus wherein the positioning of the front side image and the rear side image on the transfer material is precisely done.

The above-mentioned object is accomplished by an image forming apparatus for forming an image on both sides of a transfer material comprising an image forming member, a toner image forming means for forming a toner image on said image forming member, an intermediate transfer member, a first transfer means for transferring the toner image on said image forming member to said intermediate transfer member or to the front side of said transfer material, a second transfer means for transferring the toner image transferred on said intermediate transfer member to the rear side of said transfer material, and fixing means for fixing the toner images transferred on said transfer material, said image forming apparatus further comprising a control means for controlling the timing of writing the image in said toner image forming means and the timing of feeding the transfer material to a transfer portion on the basis of the information on the position of said intermediate transfer member.

This invention should not be confined to the embodiment to be described in the following. Further, in the following explanation of the embodiment, the image which is transferred on the transfer material surface of the side facing the image forming member at the transfer area is referred to as the front side image, and the image which is transferred on the other surface of the transfer material is referred to as the rear side image. Although the embodiments to be explained in the following are all the examples of practice regarding an image forming apparatus for forming a color image, this invention can be applied to an image forming apparatus for forming a monochromatic image.

BRIEF DESCRIPTION OF THE DRAWINGS

FIGS. 3(*a*) to 3(*c*) are drawings showing how the toner images of both sides are formed;

FIGS. 5(*a*) and 5(*b*) are illustrations for the detection of the reference position in the embodiment 1;

DETAILED DESCRIPTION OF THE PREFERRED EMBODIMENTS

First, the items, which are common to the embodiments of this invention, will be explained.

Figure 1:
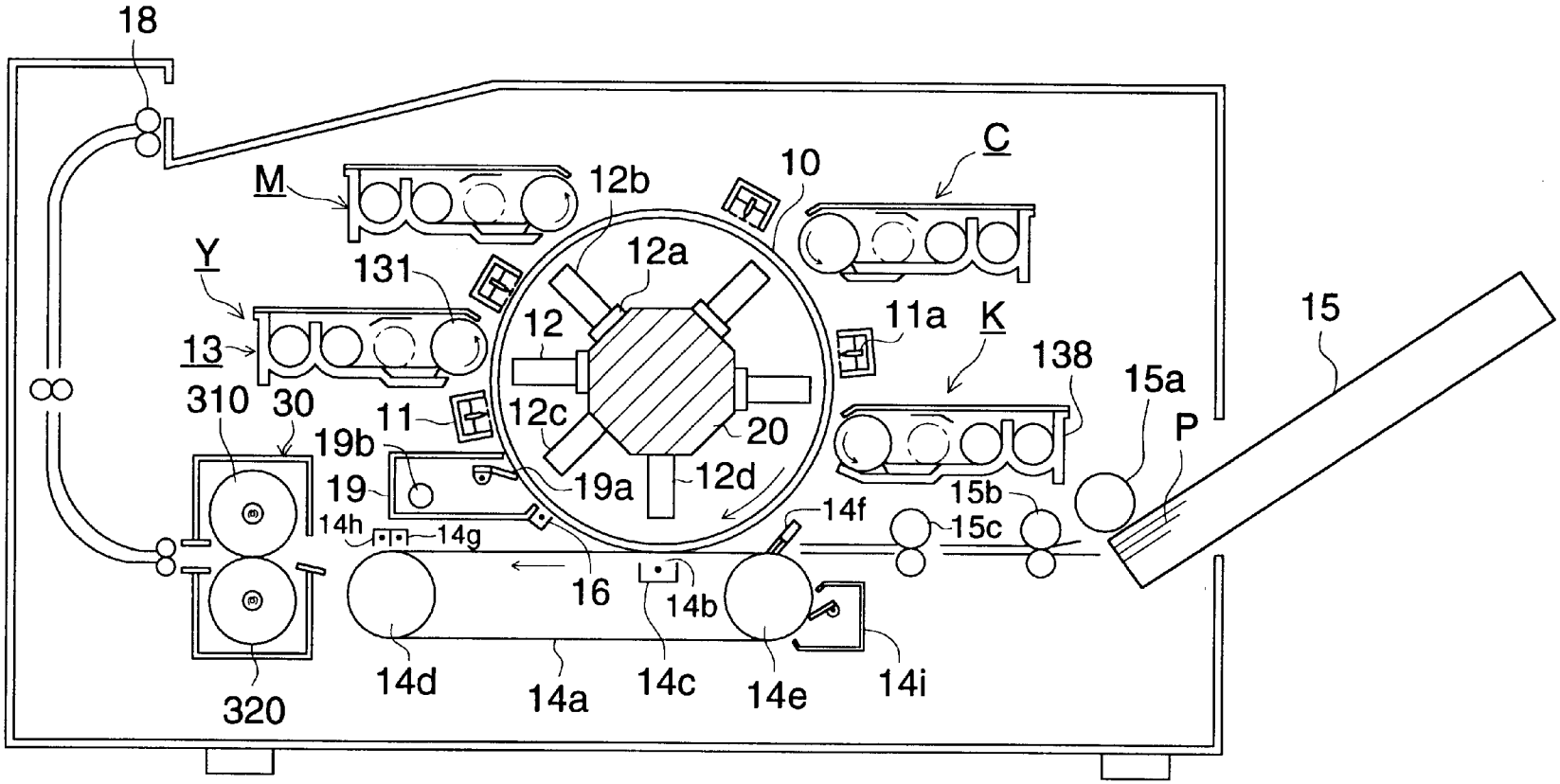
FIG. 1 is a cross-sectional view showing the construction of an image forming apparatus to which this invention is applied.
Figure 2:
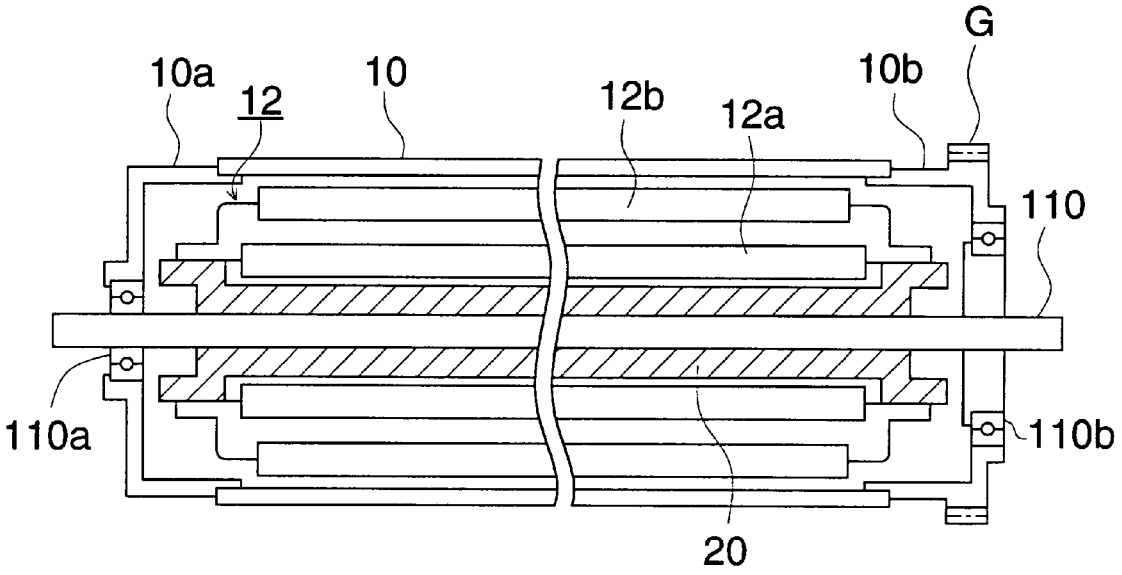
FIG. 2 is the side cross-sectional view of the image forming member in FIG. 1.

With reference to FIG. 1 through FIG. 3, the image forming process and every mechanism of an embodiment of the image forming apparatus according to this invention will be explained. FIG. 1 is a cross-sectional view of the structure of the color image forming apparatus showing an embodiment of this invention, FIG. 2 is a side cross-sectional view showing the image forming member in FIG. 1, and FIG. 3 is a drawing how the toner images of both sides relating to the embodiment are formed.

The photoreceptor drum 10, the image forming member, is provided with a cylindrical substrate member made of a transparent material such as an optical glass or a transparent acrylic resin inside, and comprises a transparent conductive layer and a photosensitive layer formed on the outer periphery of said substrate, and is rotated in the clockwise direction shown by the arrow mark in FIG. 1.

As is shown in FIG. 2, the photoreceptor drum 10, with the flange members 10*a* and 10*b* engaging with it at both end surfaces for fixing the drum supported to be able to rotate around the drum shaft 110, which is mounted and fixed to the apparatus mainframe, by the bearing members 110*a* and 110*b*, which are inserted in said flange members at both ends of the drum, is rotated at a constant speed in the predetermined direction by the driving of gear G, formed integrally on the flange member 10*b*, engaging with the driving gear in the apparatus mainframe.

The scorotron chargers 11, the charging means, are used in the image forming processes for the colors yellow (Y), magenta (M), cyan (C), and black (K), are fixed opposite to the photoreceptor drum 10, image forming member, in the direction perpendicular to the moving direction of the photoreceptor drum 10, each comprising a control grid kept at a specified electric potential against the aforesaid photosensitive layer of the photoreceptor drum 10, and a discharging electrode 11*a* made up of, for example, a sawtooth electrode, and carry out the charging process (negative charging in this embodiment) by corona discharging of the same polarity as the toners to give a uniform electric potential to the photoreceptor drum 10. As for the discharging electrode 11*a*, other electrode such as a wire electrode can be employed.

Each of the exposure units 12, the exposure means for respective colors, is disposed at a place such that the exposure position on the photoreceptor drum 10 comes between the discharging electrode 11*a* and the developing position of the developing unit 13 in the upstream side of the developing sleeve 131 with regard to the rotational direction of the photoreceptor drum.

Each of the exposure units 12 is composed of a linear light emitting element 12*a* having an array of a plurality of LED's (light emitting diodes) as the light emitting elements arranged in the main scanning direction in parallel with the shaft of the photoreceptor drum 10, a SELFOC lens 12*b* as a focusing element with magnification to the same size, and a holder not shown in the drawing to which said SELFOC lens is fitted. The exposure units for the respective colors 12, the uniform exposure device 12*c*, and the simultaneous transfer exposure device 12*d* are fitted to the holding member 20 and received inside the substrate of the photoreceptor drum 10. The image data for the respective colors, which have been read by an image reading apparatus in a separate housing and memorized in a memory, are sequentially read out from the memory and inputted in the exposure units 12 for the respective colors as the electrical signals.

As for the light emitting element, others such as an FL (fluorescent luminescence), an EL (electro-luminescence), and a PL (plasma luminescence) having a plurality of light emitting elements arranged in an array can be employed. For the wavelength of the light emitting element used in this embodiment, the one in the range of 680–900 nm, to which the toners for Y, M, and C are highly transparent, is usually suitable, but a light with a shorter wavelength than the above-mentioned, to which color toners have not sufficient transparency, may be used because the exposure is made from the inside (rear side) of the photoreceptor drum 10.

Among the developing units 13, which are arranged around the peripheral surface of the rotating photoreceptor drum 10 in accordance with the order of the color image formation, in this embodiment, the developing units for the colors Y and M are disposed in the left side of the photoreceptor drum 10, and the developing units for the colors C and K are disposed in the right side of the photoreceptor drum 10. Further, under the encasing members 138 of the developing units for the colors Y and M, the scorotron chargers 11 for the colors Y and M are disposed respectively, and over the encasing members 138 of the developing units 13 for the colors C and K, the scorotron chargers for the colors C and K are disposed respectively.

The developing units 13, the developing means for the respective colors, receive single- or two-component developers of the colors yellow (Y), magenta (M), cyan (C), and black (K) respectively, and are provided with the developing sleeve 131, which is positioned with a specified spacing to peripheral surface of the photoreceptor drum 10 and rotates in a manner such that both surfaces move in the same direction at the developing position, and is made up of a cylinder having, for example, a thickness of 0.5–1 mm and an outer diameter of 15–25 mm, formed out of a non-magnetic stainless steel or an aluminum material.

The developing sleeve 131 is kept in a position of noncontact with the photoreceptor drum 10 with a predetermined spacing for development of, for example, 100–1000 $\mu$m by a rolling spacer not shown in the drawing. At the time of development operation by the developing units 13 for the respective colors, a development bias voltage composed of a direct current voltage or an alternating current voltage in addition to the direct current voltage are applied to the developing sleeve 131 to carry out jumping development with the single- or two-component developers received in the developing units. On this occasion, a direct current voltage of the same polarity as the toners (negative polarity in this embodiment) is applied to the sleeve for the negatively charged photoreceptor drum 10 with its transparent conductive layer grounded so that the reverse development wherein toner particles are deposited on the exposed areas may be made. The deviation of the development spacing should not exceed 20 $\mu$m in order to prevent uneven developing.

In the toner image forming means as has been described in the foregoing, the developing units 13 for the respective colors develop the latent electrostatic images formed on the photoreceptor drum 10 through the charging by the aforesaid scorotron chargers 11 and the image exposure by the exposure units 12 with the toners of the same polarity as that of the charging (in this embodiment, toners of negative polarity because the photoreceptor drum is negatively charged) in a state of non-contact with the photoreceptor by the non-contact development method with the above-mentioned development bias voltage applied to the sleeve.

The image data of an original document image which are read by an image sensor in the image reading apparatus in a separate housing from this apparatus, or the image data of the image compiled by a computer are memorized and stored in a memory as the respective image data for the colors Y (yellow), M (magenta), C (cyan), and K (black).

When image recording starts, the gear G provided in the rear side flange 10*b* of the photoreceptor drum 10 is rotated through the gear for driving not shown in the drawing by the start of the motor for driving the photoreceptor not shown in the drawing, to rotate the photoreceptor drum 10 in the clockwise direction shown by the arrow mark in FIG. 1. At the same time, the charging to give a potential to the photoreceptor drum 10 is started by the charging operation of the scorotron charger 11 for Y disposed under the encasing member 138 of the developing unit 13 for yellow (Y) in the left side of the photoreceptor drum 10.

After giving the electrical potential to the photoreceptor drum 10, the exposure by the first color signal, that is, the electrical signal corresponding to the image data for Y is started in the exposure unit 12 for Y to form a latent electrostatic image corresponding to the image for Y of the original document images on the photosensitive surface layer of the photoreceptor drum 10 through the rotational scanning of it.

The above-mentioned latent image is reversely developed by the developing unit 13 for Y in the non-contact state to form the toner image of yellow (Y) with the rotation of the photoreceptor drum 10.

Next, the photoreceptor drum 10 is given the electric potential by the charging operation of the scorotron charger 11 for magenta (M) disposed over the developing encasing 138 of the developing unit 13 for yellow (Y) and under that for magenta (M) in the left side of the photoreceptor drum 10, and is subjected to the exposure in the exposure unit 12 for M by the second color signal, that is, the electrical signal corresponding to the image data for M, to form the toner image of magenta (M) superposed on the aforesaid toner image of yellow (Y) by the non-contact reverse development of the developing unit 13 for M.

Through the same process as mentioned above, it is formed further sequentially superposed the toner image of cyan (C) corresponding to the third color signal by the scorotron charger 11 for cyan (C) disposed over the encasing member 138 of the developing unit 13 for cyan (C) in the right side of the photoreceptor drum 10, the exposure unit 12 for C, and the developing unit 13 for C, and the toner image of black (K) corresponding to the fourth color signal, by the scorotron charger 11 for black (K) disposed under the encasing member 138 of the developing unit 13 for C and over that for K in the right side of the photoreceptor drum 10, the exposure unit 12 for K, and the developing unit 13 for K, to form the color toner image on the peripheral surface of the photoreceptor drum 10 in one rotation of photoreceptor drum 10.

The exposure to the organic photosensitive layer of the photoreceptor drum 10 by these exposure units for Y, M, C, and K is carried out from the inside of the drum through the aforesaid transparent substrate. Accordingly, any one of the image exposures corresponding to the second, third, and fourth color signals is carried out without being influenced by the previously formed toner images at all; hence, it is possible to form the latent electrostatic image of equal quality to the image corresponding to the first color signal.

Through the above-mentioned image forming process, the superposed color toner images to be made the rear side image are formed on the photoreceptor drum 10, the image forming member, and these superposed color toner images for the rear side image on the photoreceptor drum 10 are transferred all at a time at the transfer area onto the toner image receiving member 14*a*, the intermediate transfer member entrained around the driving roller 14*d* and the driven roller 14*e* to be positioned in the vicinity of, or in contact with the photoreceptor drum 10, by the first transfer unit 14*c* to which a direct current voltage of the reverse polarity to the toners (positive in this embodiment) is applied (FIG. 3(*a*)). At this time, a uniform exposure by the simultaneous transfer exposure unit 12*d* employing, for example, a light emitting diode is carried out.

The toner particles remaining on the peripheral surface of the photoreceptor drum 10 after transfer are subjected to the charge eliminating by AC erasing unit 16 for the image forming member, and then come to the cleaning unit 19, where they are cleaned off by the cleaning blade 19*a* made up of a rubber material engaging with the photoreceptor drum 10. Further, in order to eliminate the history of the photosensitive member up to the previous printing, charge elimination on the peripheral surface of the photosensitive drum is made by the pre-charging uniform exposure unit 12*c* employing, for example, a light emitting diode. Thus, the charge given in the previous printing is eliminated and the next color image forming is successively carried out.

The superposed color toner images for the front side image are formed on the photoreceptor drum 10 in the same manner as the above-described color image forming process, keeping synchronism with the toner images for the rear side formed on the toner image receiving member 14*a* at the transfer area 14*b* (FIG. 3(*b*)). In addition, the image data of the images for the front side are required to be modified in a manner such that the image for the front side is converted into the mirror image of the original on the photoreceptor drum 10.

With the image formation for the front side on the photoreceptor drum 10, the recording paper P, the transfer material, is conveyed out from the paper feeding cassette 15, the transfer material receiving means, by the convey-out roller 15*a*, and is transported to the timing roller 15*c* by the feed roller 15*b*.

The recording paper P is transported to the transfer area 14*b* by the driving of the timing roller 15*c*, keeping synchronism with the color toner images for the front side image borne on the photoreceptor drum 10 and the color toner images for the rear side image borne on the toner image receiving member 14*a*. At this time, the recording paper P is charged to the same polarity as the toners by the paper charger 14*f*, the transfer material charging means, and is transported to the transfer area 14*b*, attracted to the toner image receiving member 14*a*. Charging the paper to the same polarity as the toners prevents the paper from attracting the toner images on the toner image receiving member 14*a* and the toner images on the photoreceptor drum 10, so that the toner images may be prevented from being disturbed. Further, as for the transfer material charging means, a conductive roller or a brush charger capable of engaging with and disengaging from the toner image receiving member 14*a* may be employed.

The toner images for the front side on the peripheral surface of the photoreceptor drum 10 are transferred all at a time onto the upper side (front side) of the recording paper P by the first transfer unit 14*c*, the first transfer means, to which a voltage of the reverse polarity to the toners (positive polarity in this embodiment) is applied. At this time, the toner images for the rear side on the peripheral surface of the toner image receiving member 14*a* are not transferred to the recording paper P, remaining on the toner image receiving member. Next, the toner images for the rear side on the peripheral surface of the toner image receiving member 14*a* are transferred at one time onto the lower side (rear side) of the recording paper P by the rear side transfer unit 14*g*, the second transfer means, to which a voltage of the reverse polarity to the toners (positive polarity in this embodiment) is applied (FIG. 3(*c*)).

Because the toner images for the respective colors are superposed on one another, it is favorable in order to make it possible to transfer the toner images at one time that the toner particles in the upper layer and those in the lower layer among the toner layers have a charge of the like amount and of the same polarity. For this reason, the duplex image forming method, wherein the charge polarity of the color toner images formed on the toner image receiving member 14*a* is reversed by corona charging, or the charge polarity of the color toner images formed on the photoreceptor drum 10 is reversed by corona charging, is not favorable due to the poor transfer resulted from an insufficient charging of the toner particles in the lower layers.

It is favorable because of the contribution to the improvement in the transfer efficiency for the rear side image forming that the color toner images all having the same charge polarity formed by repeating reverse development superposed on the photoreceptor drum 10 are first transferred at one time to the toner receiving member 14*a* without changing the polarity and next transferred at one time to the recording paper P without changing the polarity. Regarding the front side image forming, it is favorable because of the contribution to the improvement in the transfer efficiency for the front side image forming that the color toner images all having the same charge polarity formed by repeating reverse development superposed on the photoreceptor drum 10 are transferred at one time to the recording paper P without changing the polarity.

For the reasons stated above, it is favorably employed in color image forming the duplex image forming method wherein the first transfer means and the second transfer means are provided separately, and a color toner image is formed on the front side of a transfer material by operating the first transfer means, and next another color toner image is formed on the rear side of the transfer material.

The toner image receiving member 14*a* is composed of two layers, one of which is a semi-conductive substrate having a resistivity value in the range of $10^8$–$10^{12}$ cm made up of an endless rubber belt with a thickness of 0.5–2.0 mm made of silicone rubber or polyurethane rubber, and the other is a fluorine resin layer for preventing toner filming coated on the outer side of the rubber substrate with a thickness of 5–50 $\mu$m. The outer layer also should favorably be semi-conductive. In place of the rubber belt, a semi-conductive belt made of polyester, polystyrene, polyethylene terephthalate, or the like with a thickness of 0.1–0.5 mm can be used for the substrate.

The recording paper P, the transfer material, having color toner images formed on both sides of it is subjected to the charge eliminating process by the AC charge eliminating unit for paper pick-off 14*h*, picked off from the toner receiving member 14*a* by the curvature of the driving roller 14*d*, and is transported to the fixing unit 30, the fixing means, composed of two fixing rollers having a heating means (heater) respectively in both upper and lower rollers, which will be explained later. The recording paper P, with the toner particles adhering to the front and rear side of it fixed by the application of heat and pressure between the upper-positioned first fixing roller 310 and the lower-positioned second fixing roller 320, having images recorded on both sides, is conveyed by the paper ejecting rollers 18, and is discharged on the tray outside the apparatus.

The toner particles remaining on the peripheral surface of the toner image receiving member 14*a* after transfer process are cleaned off by the cleaning blade, 14*j* which is capable of engaging with and disengaging from the toner image receiving member 14*a* and provided in the cleaning unit 14*i* for the toner image receiving member 14*a*, the cleaning means for the toner image receiving member. On the other hand, the toner particles remaining on the peripheral surface of the photoreceptor drum 10 after transfer process are subjected to charge eliminating process by the AC charge eliminating unit 16 for the image forming member, and then comes to the cleaning unit 19, where they are scraped off into the cleaning unit 19 by the cleaning blade 19*a*, which is made of a rubber material and engaging with the photoreceptor drum 10, and received in the residual toner container not shown in the drawing. The photoreceptor drum 10, with the remaining toner particles removed from its surface by the cleaning unit 19, after the charge elimination from its surface through the exposure by the uniform exposure unit 12*c*, is subjected to the uniform charging process by the scorotron 11 for Y and enters in the next image forming cycle.

In the duplex image forming process explained up to now, it has been heretofore studied to carry out image forming in accordance with a program (time table) for the duplex image forming which is memorized beforehand in a ROM and is read out at the time of image forming. However, it is difficult to fit the positions of the leading edges of the front side image and the rear side image to the transfer paper, and for example, when the image forming is made in a linear speed of 200 mm/s, the timing error of 5 ms produced makes a deviation of image position of 1 mm.

Figure 4:
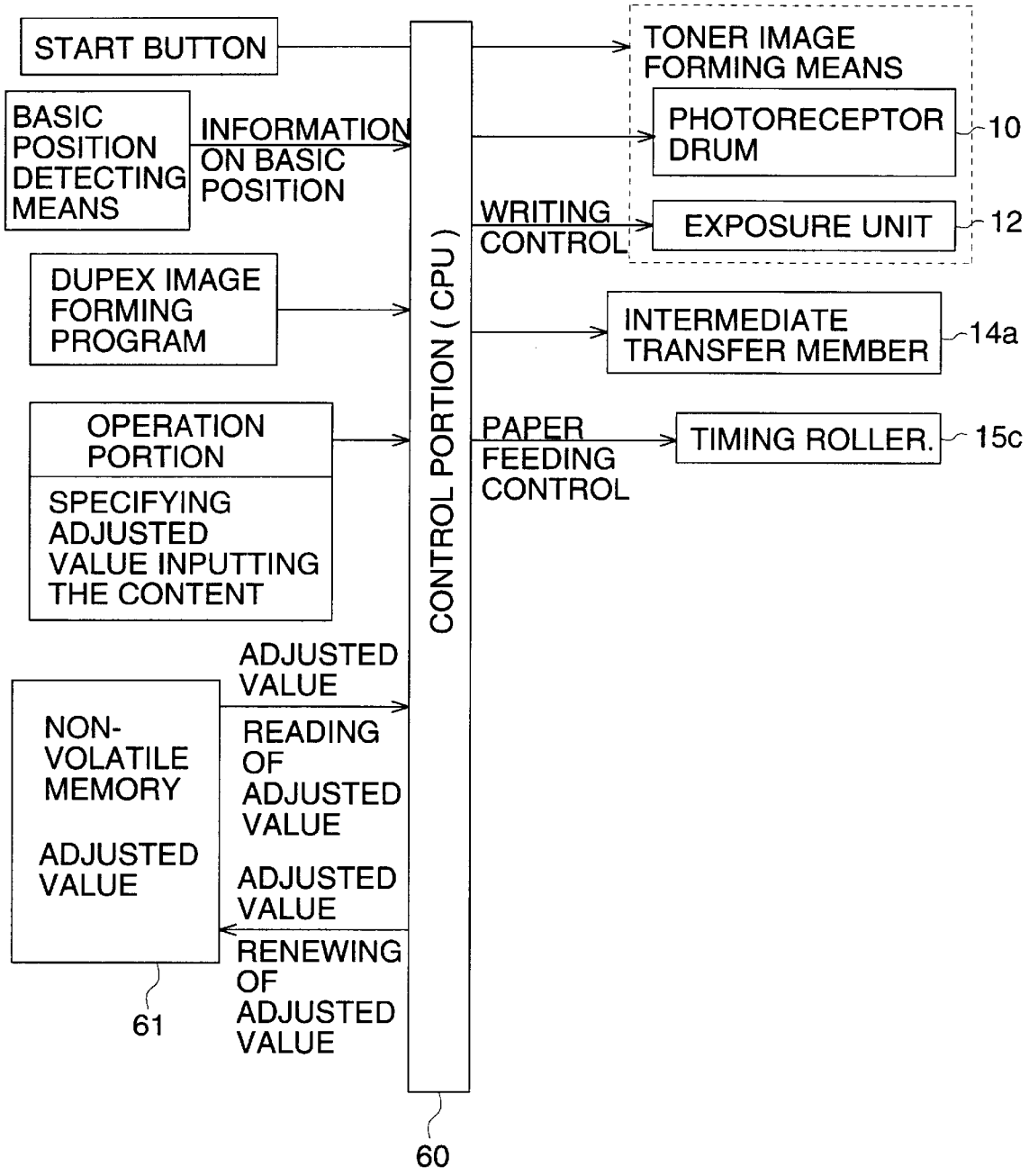
FIG. 4 is a block diagram showing the control system according to this invention.

Further, the time interval from the timing of writing of the rear side image to the timing of writing of the front side image is theoretically determined by L/V, where L stands for the length of the circumference of the intermediate transfer member and V stands for the linear speed, however practically, the length of the circumference varies to $L \pm \Delta L$, the linear speed varies to $V \pm \Delta V$, and the above-mentioned time interval varies to $(L \pm \Delta L)/(V \pm \Delta V)$ to present the deviation in the leading edge position between the front side image and the rear side image due to the elongation of the intermediate transfer member belt, slippage of it between the driving roller, fluctuation in the load against the driving roller, etc. Such phenomena as mentioned above are eliminated by this invention, wherein a control means for controlling the timing of image writing and the timing of transfer material feeding to the transfer area 14*b* on the basis of the positional information of the intermediate transfer member (toner image receiving member 14*a*) is provided, and the duplex image forming is carried out under this control. FIG. 4 is a block diagram showing this control system. In addition, the word positional information in the above means the information on the rotational position of the intermediate transfer member, in the case where the intermediate transfer member (a belt, a drum, or the like, for example) rotates or revolves.

Embodiment 1

In this embodiment, there is provided the control portion 60 for controlling the timing of image writing and the timing of transfer material feeding to the transfer area 14*b* on the basis of a reference position (marking portion) defined on the toner image receiving member and the positional information obtained by a detecting means for detecting said reference position.

In FIG. 5, two examples wherein the positional information is obtained by such means as mentioned above are shown. FIG. 5(*a*) shows the example wherein the detection of the reference position is made in a manner such that a small hole 141*a* is provided on the revolving toner image receiving member 14*a* for the reference position, and a light emitting element 51*a* is provided at a position inside the toner image receiving belt 14*a*, together with a light sensing element 52*a* provided at the position outside the belt opposite to said inside position (a transmission type sensor), so that the light sensing element 52*a* may receive the visible or invisible light transmitted through the small hole 141*a*. For making the accuracy of detection high, it is made by detecting the edge of the end surface of the small hole 141*a* with the pencil of light from the light emitting element 51*a* converged.

Further, FIG. 5(*b*) shows the example wherein the detection of the reference position is made in a manner such that a small mirror portion 141*b* having a reflectance different from the other portion is provided on the inner surface of the revolving toner image receiving member 14*a* for the reference position, and a light emitting element 51*b* emitting light against the small mirror portion 141*b* and a light sensing element 52*b* receiving the light reflected by the small mirror portion 141*b* are provided (a reflection type sensor), so that the output from the light sensing element 52*b* may vary with the mirror portion. The accuracy of detection is made high by defining a threshold value regarding the output variation.

Figure 6:
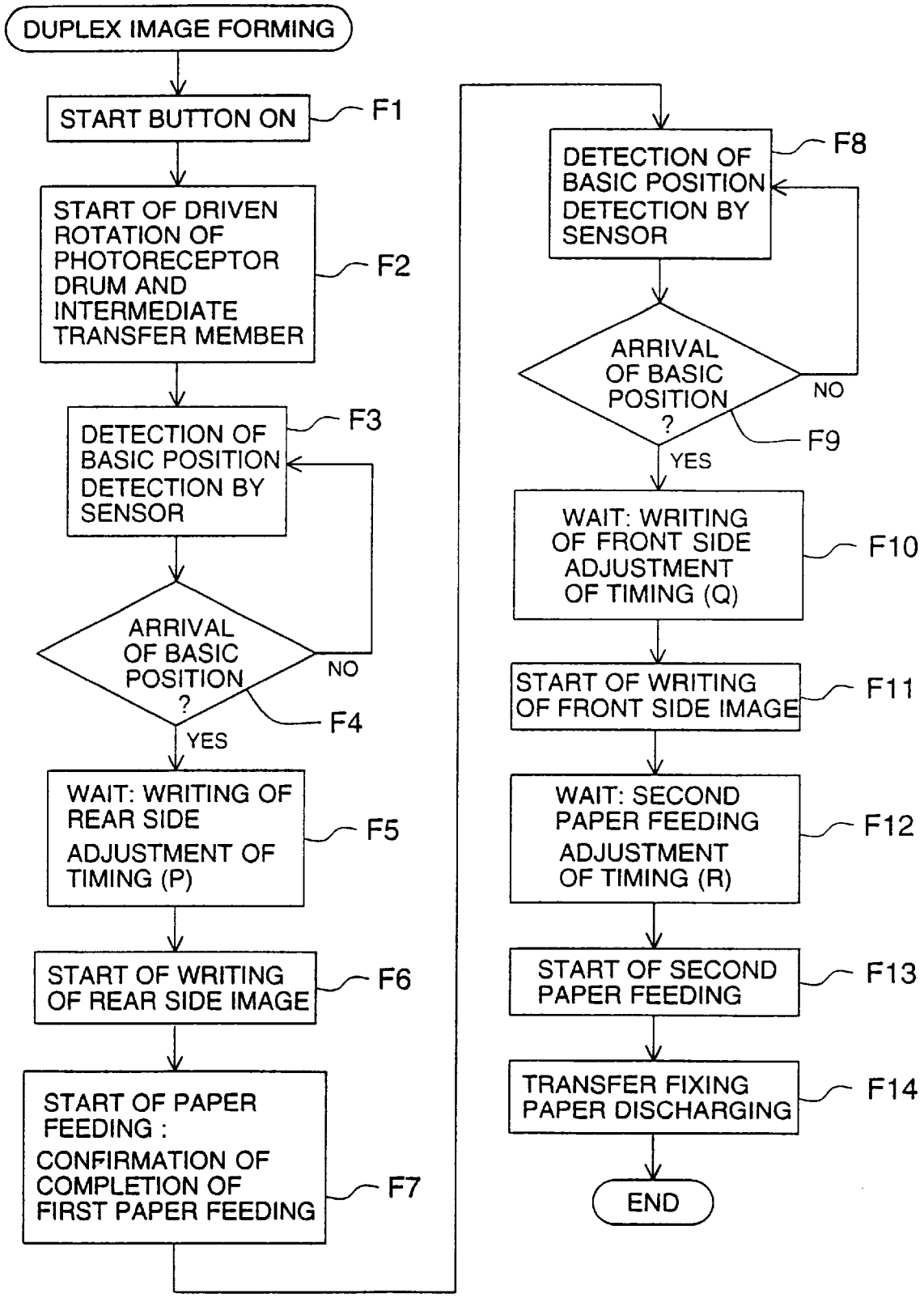
FIG. 6 is a flow chart in the embodiment 1.

FIG. 6 is a flow chart for the double side image forming in this embodiment. According to this flow chart, the duplex image forming of this invention will be explained.

When the duplex image forming mode is selected and the start button pressed (F1), the photoreceptor drum 10 and the toner image receiving member 14*a* start to be driven to rotate in accordance with the instruction from the control portion 60 (F2). The photoreceptor drum 10 and the toner image receiving member 14*a* are driven by separate driving motors respectively, and pulse motors are favorably used.

Next, the detection of the reference position (141*a* or 141*b*) provided on the toner image receiving member 14*a* is made by the sensor (51*a* and 52*b*) (F3). When the arrival of the reference position (141*a* or 141*b*) is detected by the sensor (51*b* and 52*a*) (F4), after waiting for a previously adjusted timing (P) memorized in the non-volatile memory 61 (F5), the write-out for the rear side image is started by the exposure unit 12 (F6). Then, the recording paper P is conveyed out from the paper feeding cassette 15 by the convey-out roller 15*a*, and is transported to the timing roller 15*c* in the stop state, where it is stopped temporarily, and confirmation of the completion of the first paper feeding is made (F7).

After one revolution of the toner image receiving member 14*a*, the detection of the reference position (141*a* or 141*b*) is made again by the sensor (51*a* and 52*a*) (F8). When the arrival of the reference position (141*a* or 141*b*) is detected by the sensor (51*a* and 52*a*) (F9), after waiting for a previously adjusted timing (Q) memorized in the non-volatile memory 61 (F10), the writing of the front side image is started by the exposure unit 12 (F11). In this case, the timing (P) and the timing (Q) both may have the same value, or may be zero.

Further, after waiting from the time of the second arrival of the reference position (F9) for a previously adjusted timing (R) memorized in the non-volatile memory 61 (F12), the timing roller 15*c* starts to rotate, that is, it starts to feed the recording paper to the transfer area 14*b* (the second paper feeding) (F13). After the transfer and fixing of the front and rear side images on the recording paper, it is discharged out of the machine (F14).

In addition, the above-described operation is carried out under the control of the control portion 60, and the aforesaid adjusted values of the timings (P), (Q), and (R) are memorized in the non-volatile memory 61, from which they are read out at the times of arrival of the reference position (F4 and F9). Moreover, these timings (P), (Q), and (R) can be re-written in the operation portion, and can be renewed properly using the numerical keys in the operation portion, if some deviation between the leading edge positions is detected by checking the recording paper being ejected as the occasion demands.

In this embodiment, the leading edge position of the toner image formed on the belt of the toner image receiving member 14*a* is always fixed on the basis of the reference position (141*a* or 141*b*) provided on the belt; hence, when a belt with a seam, not an endless one, is used for the toner image receiving member 14*a*, this embodiment has also a merit to be able to form a toner image always on the portion without seam.

Embodiment 2

In this embodiment, there is provided the control portion 60 for controlling the timing of image writing and the timing of transfer material feeding to the transfer area 14*b* on the basis of the positional information derived from the information on the amount of driving obtained from the driving roller 14*d* for driving the toner image receiving member.

Figure 7:
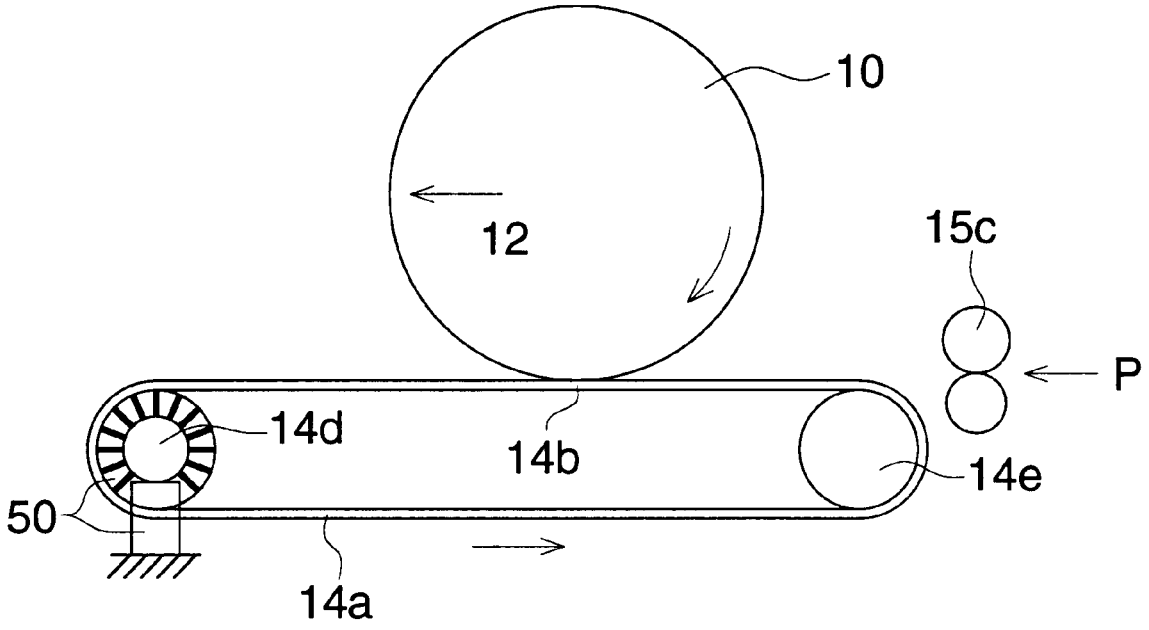
FIG. 7 is an illustration for the detection of the basic position in the embodiment 2.

In FIG. 7, it is shown the embodiment obtaining the above-mentioned information on the amount of driving, wherein the encoder 50 is provided on the driving roller 14*d* which is rotated by a driving motor not shown in the drawing to drive the toner image receiving member 14*a*, so that the angle of rotation (the information on the amount of driving) of the driving roller 14*d* may be obtained. The encoder 50 is composed of a code plate made up of a circular plate mounted in parallel with the end surface of the driving roller 14*d* and having notch portions or markings with equal intervals and a detecting portion for reading these notch portions or markings photo-electrically, and in the detecting portion, the amount of driving of the driving roller 14*d* is encoded and detected as the number of pulses.

Figure 8:
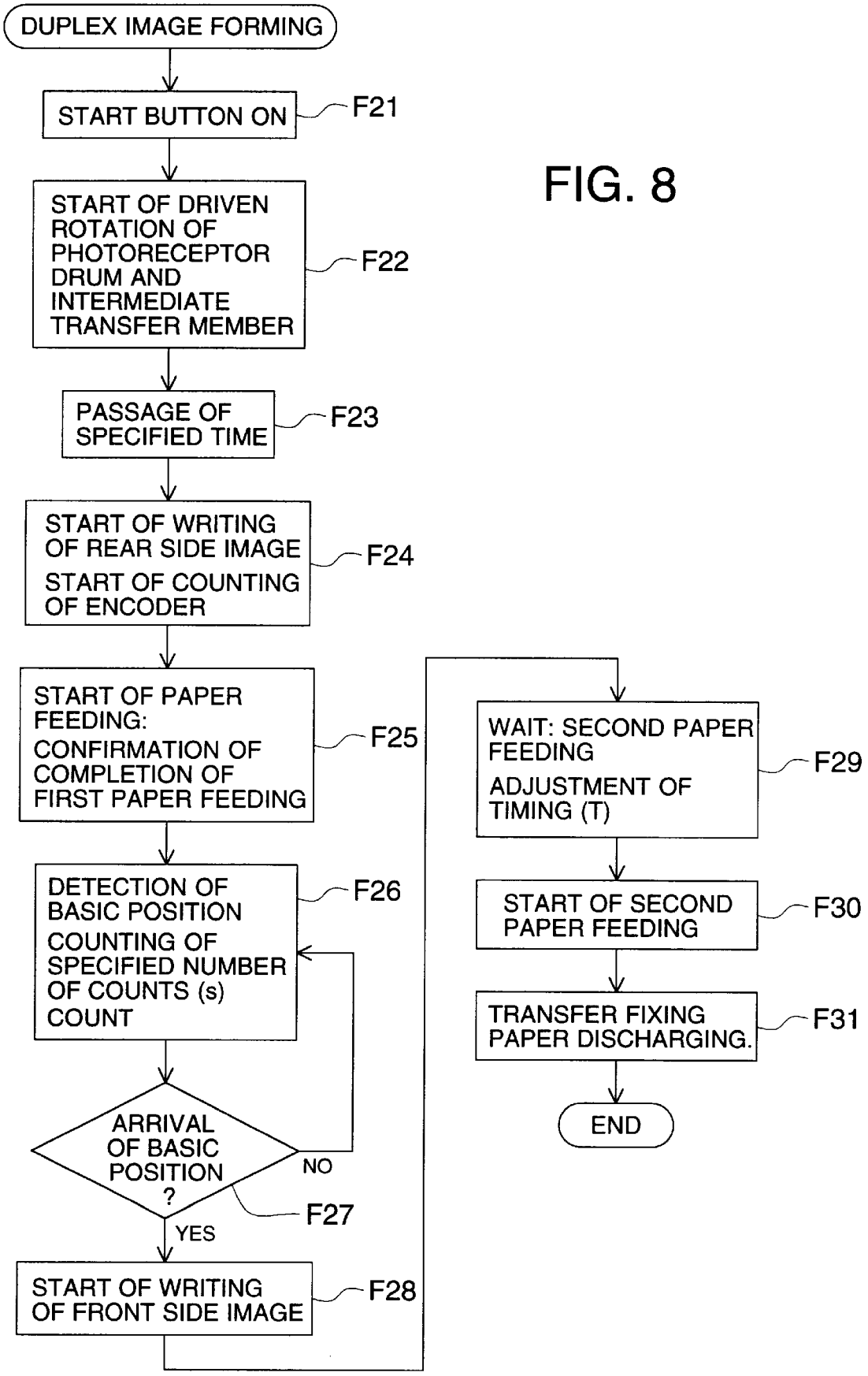
FIG. 8 is a flow chart in the embodiment 2.

FIG. 8 is a flow chart for the double side image forming in this embodiment. When the duplex image forming mode is selected and the start button is made on (F21), the photoreceptor drum 10 and the toner image receiving member 14*a* start being driven to rotate in accordance with the instruction from the control portion 60 (F22). The photoreceptor drum 10 and the toner image receiving member 14*a* are driven by separate driving motors respectively, and pulse motors are favorably used.

After the rotational speed has become constant and the time necessary for the image forming process to set in has passed (F23), the writing of the rear side image is started, and at the same time, counting for the amount of driving by the encoder 50 is started (F24). Next, the recording paper P is conveyed out from the paper feeding cassette 15 by the convey-out roller 15*a*, is transported to the timing roller 15*c* in the stop state, where it is stopped temporarily, and confirmation of the completion of the first paper feeding is made (F25).

Next, it is checked whether the number of the counts by the encoder 50 has reached to the specified number for the timing such that the toner image receiving member 14*a* makes one revolution and the encoder returns to the start position or not. The above-mentioned number of counts (S) is an adjusted value which is memorized in the non-volatile memory 61 and read out from it. When the arrival of the reference position is done, that is, the number of counts by the encoder 50 reaches to the specified number of counts (S) (F27), the writing of the front side image by the exposure unit 12 is started (F28).

Then, after waiting from the arrival of the reference position (F27) for the previously adjusted timing (T) memorized in the non-volatile memory 61 (F29), the timing roller 15*c* starts to rotate, that is, it starts to feed the recording paper to the transfer area 14*b* (the second paper feeding) (F30). After the transfer and fixing of the front and rear side images on the recording paper, it is discharged out of the machine (F31).

The above-described operation is carried out under the control of the control portion 60, and the aforesaid adjusted values of the number of counts (S) and the timing (T) are memorized in the non-volatile memory 61, from which they are read out at the times of the start of counting (F24) and the arrival of the reference position (F27). Moreover, the number of counts (S) and the timing (T) can be re-written in the operation portion, and can be renewed properly using the numerical keys in the operation portion, if some deviation between the leading edge positions is detected by checking the recording paper being ejected as the occasion demands.

According to the present invention, even in the image forming apparatus wherein toner images are formed on the both front and rear sides and are fixed both at a time, it has become possible to obtain a copy having the front side toner image and the rear side toner image made coincident without deviation of the positions of their leading edges against the leading edge of the transfer material by making a control with the timings previously specified.

According to the present invention, the deviation of the leading edges will not occur without altering the adjustment of the specified timings, even in the case where there are elongation of the belt of the intermediate transfer member, slippage of the belt between the driving roller, and the speed fluctuation of the driving motor.

According to the present invention, the deviation of the leading edges will not occur without altering the adjustment of the specified number of counts and timings, even when the motor slippage due to the variation of the load of the driving motor for driving the intermediate transfer member occurs.

According to the present invention, in the cases where the deviation of the leading edges occurs from some causes, the previously specified timings and number of counts can be altered and renewed; hence, the user or the serviceman modifies them, so that the duplex images without the deviation of leading edges can be always obtained if the deviation should happen.

What is claimed is:

1. A duplex image forming apparatus adapted to form a first toner image on a first side of a transfer sheet and a second toner image on a second side of a transfer sheet, said apparatus comprising:

an initial image bearing member;

an image forming unit, including an exposure unit and a developing unit, adapted to form said first toner image and said second toner image on said initial image bearing member, said image forming unit starting to form said second toner image at timing (P);

an intermediate image bearing member provided with a reference position;

a first transfer unit adapted to transfer said second toner image from said initial image bearing member to said intermediate image bearing member;

said image forming unit starting formation of said first toner image at timing (Q);

a sheet feeder adapted to feed said transfer sheet toward said first transfer unit, said sheet feeder starting to feed at time (R);

said first transfer unit adapted to transfer said first toner image onto said first side of said transfer sheet;

a second transfer unit adapted to transfer said second toner image from said intermediate image bearing member onto said second side of said transfer sheet;

a fixing unit to fix said first toner image on said first side of said transfer sheet and said second toner image on said second side of said transfer sheet simultaneously;

a detector to detect said reference position on said intermediate image bearing member; and a control for said timings (P), (Q), and (R) based on detection of said reference position, whereby a leading edge of said first toner image on said first side of said transfer sheet and a leading edge of said second toner image on said second side of said transfer sheet coincide with a leading edge of said transfer sheet.

2. The duplex image forming apparatus of claim 1 wherein said intermediate image bearing member is provided with a marking portion and said detector detects said reference position by detecting said marking portion.

3. The duplex image forming apparatus of claim 1 comprising:

a driving unit for rotating said intermediate image bearing member, wherein said detector detects said reference position on said intermediate image bearing member from an amount of rotation of said driving unit.

4. The duplex image forming apparatus of claim 1 wherein said control comprises a memory for storing timing data to start forming said first toner image and said second toner image, and an adjuster to adjust said timing data.

* * * * *